US005464164A

United States Patent [19]

Doppstadt

[11] Patent Number: 5,464,164

[45] Date of Patent: Nov. 7, 1995

[54] CUTTING MEMBER OF A FLAIL FOR USE IN A ROTARY IMPACT MECHANISM OF A COMMINUTING MACHINE

[76] Inventor: Werner Doppstadt, Vossnavker Strasse 67, 42555 Velbert, Germany

[21] Appl. No.: 221,097

[22] Filed: Mar. 31, 1994

[30] Foreign Application Priority Data

Apr. 20, 1993 [DE] Germany ..... 93 05 835.7

[51] Int. Cl.[6] ..... B02C 13/28

[52] U.S. Cl. ..... 241/197; 241/300

[58] Field of Search ..... 241/195, 197, 241/292.1, 300

[56] References Cited

U.S. PATENT DOCUMENTS 1,186,071 6/1916 Bledsoe, Jr. ..... 241/197
2,318,219 5/1943 Harris ..... 241/197
4,717,083 1/1988 Quast et al. .
4,852,816 8/1989 Doppstadt .
4,871,119 10/1989 Murata et al. .

FOREIGN PATENT DOCUMENTS 325398 10/1975 Austria .
3545708 6/1987 Germany .

*Primary Examiner*—Timothy V. Eley
*Attorney, Agent, or Firm*—Collard & Roe

[57] ABSTRACT

The flail includes a cutting member which contains a cutting head. The cutting head defines a cutting edge which acts upon material to be comminuted during operation of the rotary impact mechanism. The cutting edge is made wear-resistant by having affixed thereto a plural number of wear-resistant parts made of hard metal and having a basically prismatic configuration.

11 Claims, 8 Drawing Sheets

CUTTING MEMBER OF A FLAIL FOR USE IN A ROTARY IMPACT MECHANISM OF A COMMINUTING MACHINE

CROSS-REFERENCE TO RELATED APPLICATIONS

This application is related to my U.S. patent applications Ser. No. 08/215,523 filed Mar. 22, 1994 entitled "Arcuate Impact Plate and Comminuting Machine with Arcuate Impact Plate"; Ser. No. 08/215,521, filed Mar. 22, 1994 entitled "Comminuting Machine With Comminution Grates"; Ser. No. 08/217,388, filed Mar. 24, 1994 entitled "Comminuting Machine With Comminution Cover Plate"; Ser. No. 08/217,377, filed Mar. 24, 1994 entitled "Comminuting Machine With Comb-like Further Comminuting Structure"; and Ser. No. 08/217,372, filed Mar. 23, 1994 and entitled "Infeed Means For Comminuting Machine".

BACKGROUND OF THE INVENTION

The present invention relates to a new and improved construction of the cutting member of a flail for use in a rotary impact mechanism of a comminuting machine.

In its more particular aspects, the present invention specifically relates to the new and improved construction of the cutting member which constitutes a cast body defining a cutting head exerting a comminuting action upon material impacted by the cutting head of the flail. The cutting head preferably has a substantially triangular cross-section and defines a cutting edge which extends substantially parallel to the rotational axis of the rotary impact mechanism once the cutting member is installed in the rotary impact mechanism. The cutting head may be provided with a wear-resistant hard metal extending along the cutting edge.

An example of the construction of a flail of the aforementioned type is known from German Published Patent Application No. 3,545,708 filed on Jun. 25, 1987, of the applicant of the instant application. The flail serves for comminuting material in comminuting machines in which the flail is mounted between adjacent rotor discs of a rotor body which is the main component of a rotary impact mechanism. The cutting member of the flail is exchangeably mounted at a carrier which is pivotably mounted between the adjacent rotor discs such that the carrier is pivoted under the action of centrifugal forces into an operative position during rotation of the rotor body. In such operative position, the cutting member protrudes from the circumference of the rotor body. The cutting member defines a cutting edge which extends substantially parallel to the rotational axis of the rotary impact mechanism.

Flails of the aforementioned type are also used in a comminuting machine or composting equipment such as known, for example, from U.S. Pat. No. 4,852,816, granted on Aug. 1, 1989, to the applicant of the instant application. In such machine, organic or wood waste originating in forestry, municipality or building operations is comminuted and deposited in stacks or pits for composting. A trough-shaped container receives the material to be comminuted, for example, by means of a shovel loader. Infeed means are provided in the form of an infeed conveyor which is located above the bottom of the container and feeds the material to a rotary impact mechanism which drives the infed material through an entrance gap defined between an impact ledge and the rotating flails of the rotary impact mechanism. The rotary impact mechanism is formed by a plural number of rotor discs which are mounted at a common axle, and the carriers of the flails are pivotably mounted between adjacent pairs of the rotor discs. Cutting heads of the flails protrude beyond the circumference of the rotating discs and act upon the material to be comminuted during rotation of the rotary impact mechanism. The impact ledge is followed by retainer claws which extend between adjacent ones of the rotating flails for comminuting the material which has been forced through the entrance gap. An impact plate follows the retainer claws and has teeth protruding toward the rotating flails and cooperating therewith for further comminuting the material prior to its discharge through a discharge opening from a rear part of the container.

In a further development (Doppstadt shredder, type AK 330) of the aforementioned comminuting machine, the infeed means further include an intake roll which bears upon the infed material from above. The entrance gap is followed by an impact plate containing two plate sections. The two plate sections are arranged at an angle with respect to each other so that the impact plate extends along an upper part of the cylindrical action area of the rotary impact mechanism. Teeth protrude from the impact plate toward the rotary impact mechanism and are arranged in parallel rows transverse with respect to the rotational direction of the rotary impact mechanism, the rows of teeth being transversely offset from each other. There is thus defined a throughpass gap through which the incoming material is forced under the action of the rotating flails and subjected to comminuting action. Like in the aforementionned comminuting machine, the rotating flails are pivotably mounted between adjacent discs in rows which extend in axial direction of the rotary impact mechanism and which are circumferentially spaced from each other. The axial rows are offset from each other in axial direction so that the rotating flails define a substantially uninterrupted cylindrical area of action. Following the impact plate, the comminuted material is either discharged through the rear discharge opening of the container or subjected to further comminution by further comminuting means which follow the impact plate and cover the entire discharge opening or a part thereof and which cooperate with the rotating flails.

In both of the aforementioned comminuting machines the impact plate as well as the further comminuting machines are pivotably supported so as to pivot away from the rotating flails in the event that the infed material contains pieces of material which do not disintegrate under the action of the rotating flails in cooperation with the impact plate. Also, the flails are pivotably mounted such as to pivot back between the associated adjacent discs in the event that the rotating flails impact at such non-disintegratable pieces of material. The rotating flails and the impact plate are thus prevented from damage by the pieces of non-disintegratable material.

In these constructions, the cutting member and particularly the cutting edge of the cutting head, is subject to wear due to the comminuting action on the material to be comminuted. In order to reduce such wear and thus increase the useful service life of the cutting member, it has become known to provide the cutting edge with wear-resistant hard metal. As a result of the vigorous interaction with the infed material to be comminuted, even the hard metal is subject to wear and it may even happen that the hard metal is broken off from the cutting edge which will render the flail inoperative.

SUMMARY OF THE INVENTION

Therefore, with the foregoing in mind, it is a primary object of the invention to provide a new and improved construction of a cutting member of the flail for use in the rotary impact mechanism of a comminuting machine and which flail is not afflicted with the drawbacks and limitations of the prior art constructions heretofore discussed.

Another and more specific object of the present invention is directed to a new and improved construction of the cutting member of a flail for use in the rotary impact mechanism of a comminuting machine and which cutting member has improved wear resistance.

It is also an important object of the present invention to provide a new and improved construction of the cutting member of a flail for use in the rotary impact mechanism of a comminuting machine and which cutting member has an increased useful service life.

A further significant object of the present invention resides in providing a flail for use in the rotary impact mechanism of a comminuting machine and which flail has a cutting member of a favorable configuration for increasing the useful service life of such flail.

Now in order to implement these and still further objects of the invention, which will become more readily apparent as the description proceeds, the cutting member of the present development is manifested by the features that, among other things, the cutting edge is provided with a plural number of wearing parts which are disposed in juxtaposition to each other.

As a result, generally only one of the plural number of wearing parts will break off first from the cutting member under an excessive cutting load which may become effective during operation of the comminuting machine. The remaining ones of the plural number of wearing parts still render the cutting member functionable so that the loss of one of the plural number of wearing parts will not require replacement and the temporary standstill of the comminuting machine connnected therewith. It is also possible, if desired, to repair the cutting member by adding a replacement of the broken-off wearing part. Then, only this one of the plural number of wearing parts needs to be replaced and not the entire hard metal element.

Advantageously, a further increase in the useful service life of the cutting member can be achieved by configuring the cutting member in a manner which will make the cutting member less susceptible to damage under the action of excessive comminuting loads. Each one of the plural number of wearing parts assumes a basically prismatic configuration and has a first face which extends from a first side of the cutting head and which is delimited by two lateral edges and by two edges which extend toward each other from the two lateral edges and enclose an obtuse angle. The aforementioned first side of the cutting head is the front side as viewed in the rotational direction of the rotary impact mechanism in which the cutting member is installed. Each one of the plural number of wearing parts further has a second face which extends from a second side of the cutting head and which is delimited by two lateral edges and by two edges which extend toward each other from the two lateral edges and enclose an obtuse angle. The aforementioned second side of the cutting head is the rear side as viewed in the rotational direction of the rotary impact mechanism in which the cutting member is installed. The two edges which enclose an obtuse angle and which are formed on the opposite first and second faces of the wearing part, define a roof-like ridge therebetween and lateral roof-like faces which ascend from the lateral edges and converge to form the roof-like ridge.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous conponents are designated by the same refrence characters and wherein.

DETAILLED DESCRIPTION OF THE PREFERRED EMBODIMENTS

Figure 1:
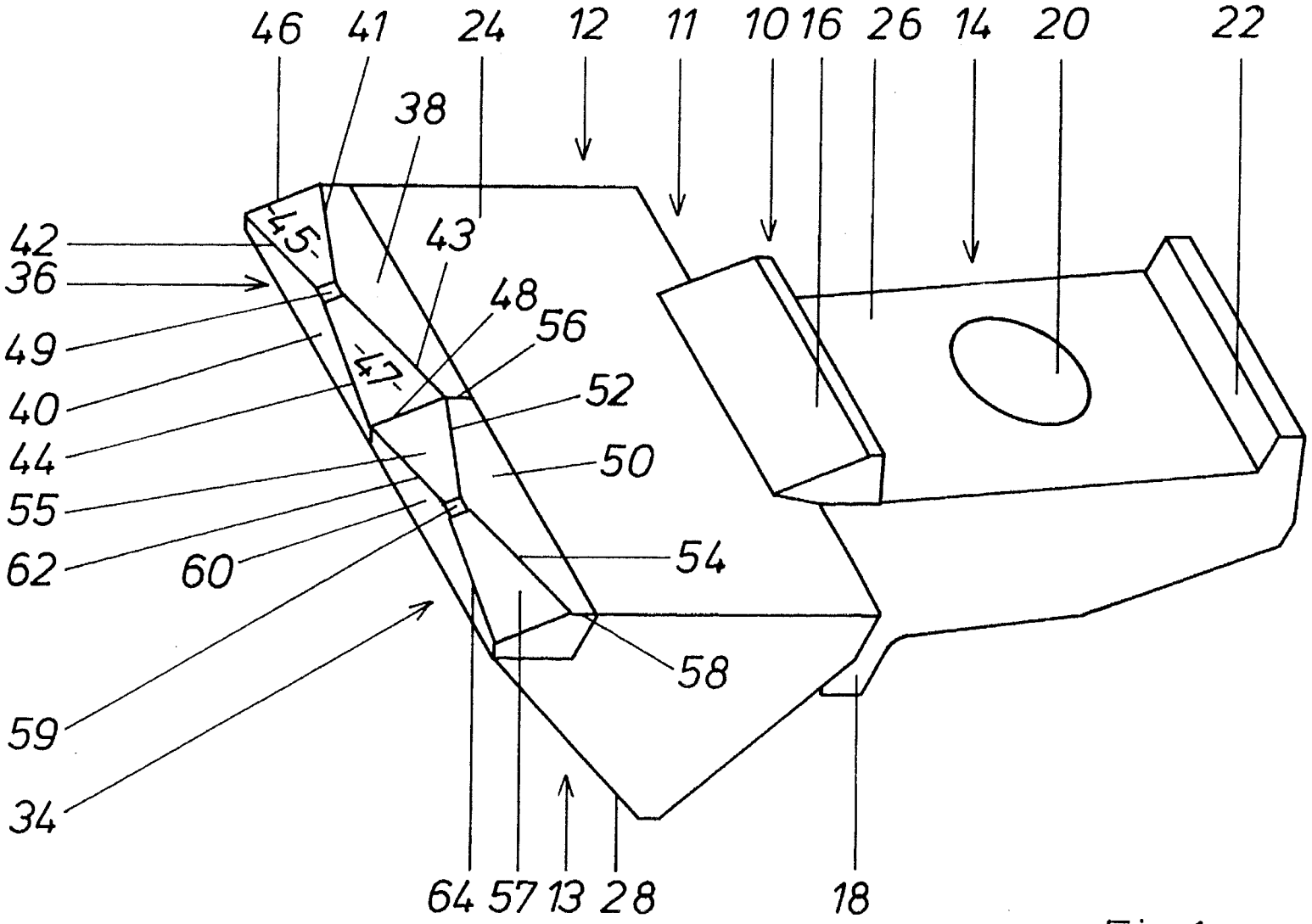
FIG. 1 is a perspective view of a first exemplary embodiment of the inventive cutting member from a first viewing direction toward a front side thereof as viewed in the rotational direction of the rotary impact mechanism in which the cutting member is installed.

Describing now the drawings, it is to be understood that only enough of the construction of the cutting member has been shown as needed for those skilled in the art to readily understand the underlying priciples and concepts of the present development, while simplifying the showing of the drawing.

In the illustrated exemplary embodiments of the inventive cutting member this member has been shown in conjunction with a construction in which the flail of the rotary impact mechanism is composed of a carrier which is pivotably mounted between two adjacent discs of the rotary impact mechanism, and a cutting member which is exchangeably connected with the carrier. The cutting member has the form of a tooth including a mounting shaft which is constructed for releasable connection with the carrier substantially in the manner as known from the initially recited German patent, and a cutting head which protrudes from the carrier and acts upon the material to be comminuted. The cutting head defines a cutting edge which is provided with a plural number of wearing parts as will be further described hereinafter. It should be understood, however, that the constructional design of such wearing parts and their connection with the cutting head is independent of the manner in which the cutting head or cutting member are interconnected with a carrier in order to form the flail.

Turning attention now to FIG. 1 of the drawings, there has been shown therein in a perspective view a first exemplary embodiment of the inventive cutting member 10 in a first viewing direction which is the direction toward a front side 11 of the cutting member 10. This front side 11 is defined by the rotational direction of the rotary impact mechanism in which the flail containing the cutting member 10 is installed. Reference is made in this respect to the initially recited United States '816 patent of the applicant; the relevant disclosure thereof is incorporated herein by reference. The position and the direction of the rotating flails is clearly evident from FIG. 2 thereof.

The cutting member 10 will be seen to have the general shape of a tooth comprising a cutting head 12 and a mounting shaft 14. The cutting head 12 has a generally wedge-shaped configuration, i.e. a substantially triangular cross-section. This cutting member 10 constitutes a cast metal part. The top side of the cutting member 10 in FIG. 1 defines the front side 11 as viewed in the rotational direction as defined hereinbefore. In the region of the transition between the cutting head 12 and the mounting shaft 14, a substantially transverse ledge 16 of triangular cross-section is provided. On the opposite side 13, i.e. the rear side as viewed in the rotational direction of the impact mechanism in which the cutting member 10 is installed, a further substantially transverse ledge 18 of substantially rectangular cross-section is provided. Furthermore, the mounting shaft 14 contains a substantially circular throughbore 20. At the end which is remote from the cutting head 12, the mounting shaft 14 has a third substantially transverse ledge 22 which protrudes from the front side 11. The transverse ledges 16, 18 and 22 as well as the throughbore 20 serve for releasably holding or retaining the mounting shaft 14 within a correspondingly configured recess of a carrier for the cutting member 10 which together constitute the flail of the rotary impact mechanism, as described in the initially mentioned German patent.

The cutting head 12 defines a substantially planar, first side 24 which is located on the front side 11 of the cutting member 10. The first side 24 extends substantially in continuation of the corresponding surface 26 of the mounting shaft 14. The opposite or second side 28, see FIG. 2, of the cutting head 12 likewise constitutes a substantially planar surface located on the rear side of the cutting member 10. The first and second sides 24 and 28 define corresponding sides of the triangular cross-section of the cutting head 12 and converge to define a rim region 30, see FIG. 3, in which the cutting edge is formed.

The rim region 30 extends substantially parallel to the rotational axis of the rotary impact mechanism when the cutting member or flail is installed at the rotary impact mechanism of the comminuting machine. A wearing body 32 is provided in the rim region 30, see FIGS. 2 and 3; in the illustrated exemplary embodiment, the rim region 30 has the form of a cut-out with two side faces which are substantially perpendicular to each other and which receive the wearing body 32 which is firmly secured such as by welding to the two side faces. The wearing body 32 is composed of a plural number of wearing parts, namely two wearing parts 34 and 36 in the exemplary embodiment illustrated in FIGS. 1 to 3. The two wearing parts 34 and 36 are disposed in juxtaposed relationship to each other so as to extend across the entire width of the cutting head 12 and define a cutting edge. Both of the wearing parts 34 and 36 are made of a highly wear-resistant material, preferably hard metal.

The wearing part 36 has a basically primatic configuration. A first face 38 thereof, see FIG. 1, extends substantially in continuation of the first or front side 24 of the cutting head 12 and is delimited by associated parts of two lateral edges 46 and 48 and two edges 41 and 43 which respectively extend from the associated parts of the two lateral edges 46 and 48 toward each other and enclose an obtuse angle. A second face 40 of the wearing part 36, see FIG. 2, extends from the second or rear side 28 of the cutting head 12 generally toward the first face 38. The second face 40 is delimited by associated parts of the two lateral edges 46 and 48 and by two edges 42 and 44 which respectively extend from the associated parts of the two lateral edges 46 and 48 toward each other and enclose an obtuse angle. The edges 41,42 and 43,44 delimit respective lateral faces 45 and 47 which ascend from associated central parts of the lateral edges 46 and 48 and converge in roof-like manner to define a roof-like ridge 49. This roof-like ridge 49 is disposed above a base of the prismatic configuration and is offset from the center in a direction away from the first or front side 24 of the cutting head 12.

The wearing part 34 is correspondingly constructed and also has a basically prismatic configuration. A first face 50 thereof, see FIG. 1, extends substantially in continuation of the first or front side 24 of the cutting head 12 and is delimited by associated parts of two lateral edges 56 and 58 and two edges 52 and 54 which respectively extend from the associated parts of the two lateral edges 56 and 58 toward each other and enclose an obtuse angle. A second face 60 of the wearing part 34 extends from the second or rear side 13 of the cutting head 12 generally toward the first face 50. The second face 60 is delimited by associated parts of the two lateral edges 56 and 58 and by two edges 62 and 64 which respectively extend from the associated parts of the two lateral edges 56 and 58 toward each other and enclose an obtuse angle. The edges 52,62 and 54,64 delimit respective lateral faces 55 and 57 which ascend from associated central parts of the lateral edges 56 and 58 and converge in roof-like manner to define a roof-like ridge 59. This roof-like ridge 59 is disposed above a base of the prismatic configuration and is offset from the center in a direction away from the first or front side 24 of the cutting head 12.

In the juxtaposed relationship of the two wearing parts 34 and 36, the respective lateral edges 48 and 56 abut each other. The lateral faces 45, 47 and 55, 57 constitute respective exposed faces and the respective edges 42,44 and 62,64 thereof conjointly define a cutting edge in conjunction with the respective roof-like ridges 49 and 59.

Figure 2:
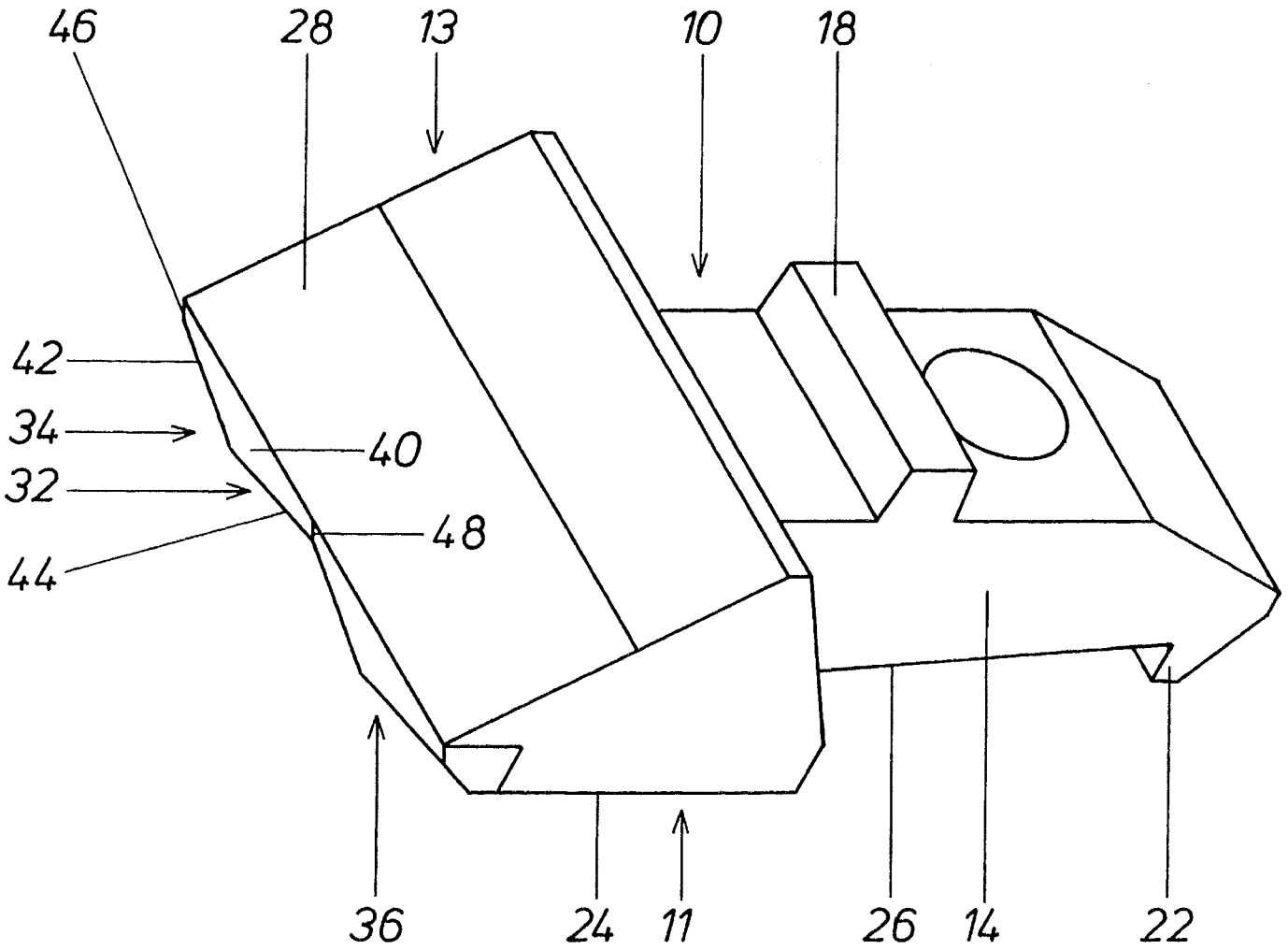
FIG. 2 is a perspective view of the cutting member as shown in FIG. 1 from a second viewing direction opposite to the first viewing direction and directed toward the rear side of the cutting member as viewed in the rotational direction of the rotary impact mechanism in which the cutting member is installed.
Figure 3:
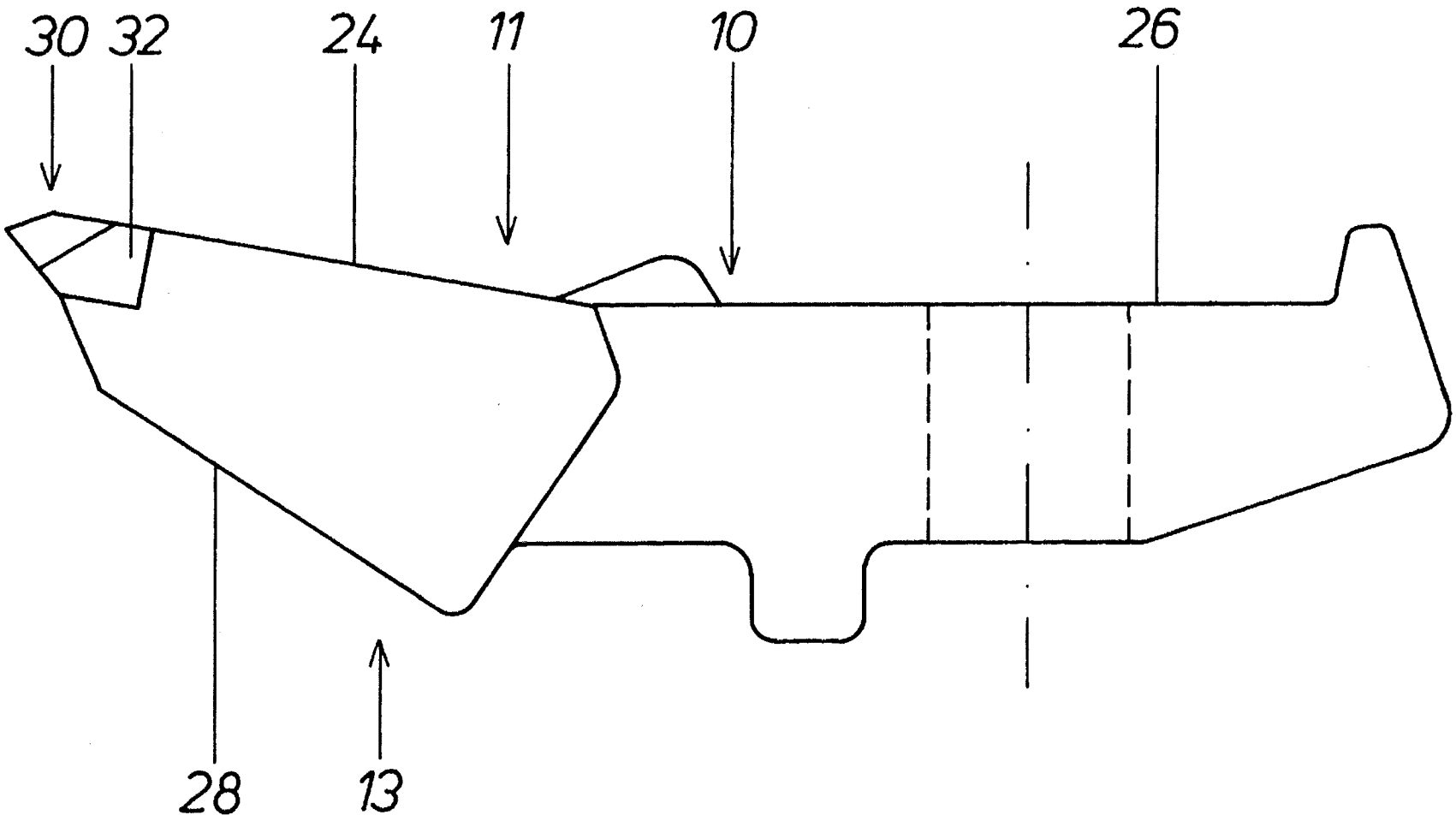
FIG. 3 is a side view of the cutting member as shown in FIG. 1.
Figure 4:
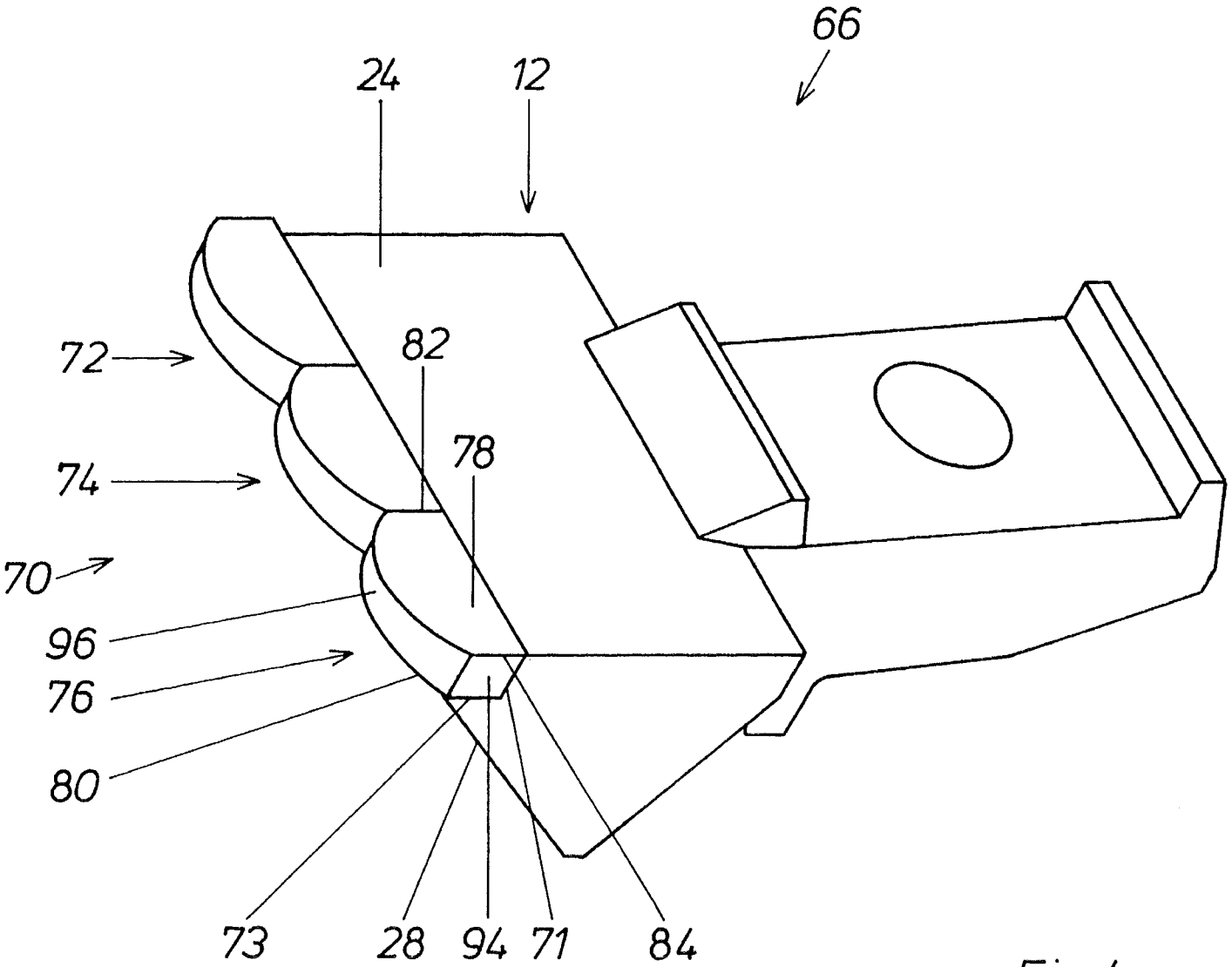
FIG. 4 is a perspective view of a second exemplary embodiment of the inventive cutting member from a first viewing direction toward a front side thereof as viewed in the rotational direction of the rotary impact mechanism in which the cutting member is installed.
Figure 5:
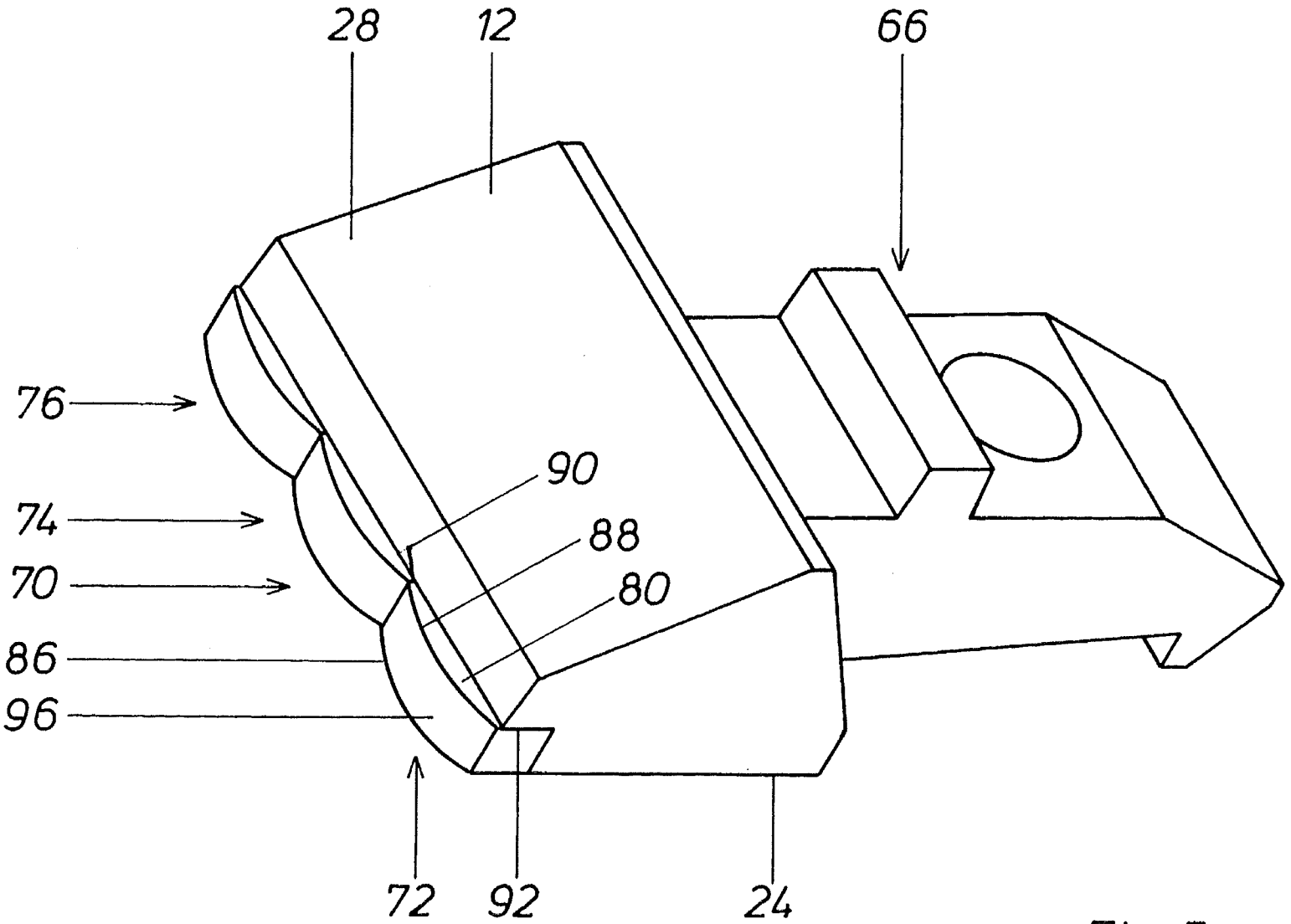
FIG. 5 is a perspective view of the cutting member as shown in FIG. 4 from a second viewing direction opposite to the first viewing direction and directed toward the rear side of the cutting member as viewed in the rotational direction of the rotary impact mechanism in which the cutting member is installed.
Figure 6:
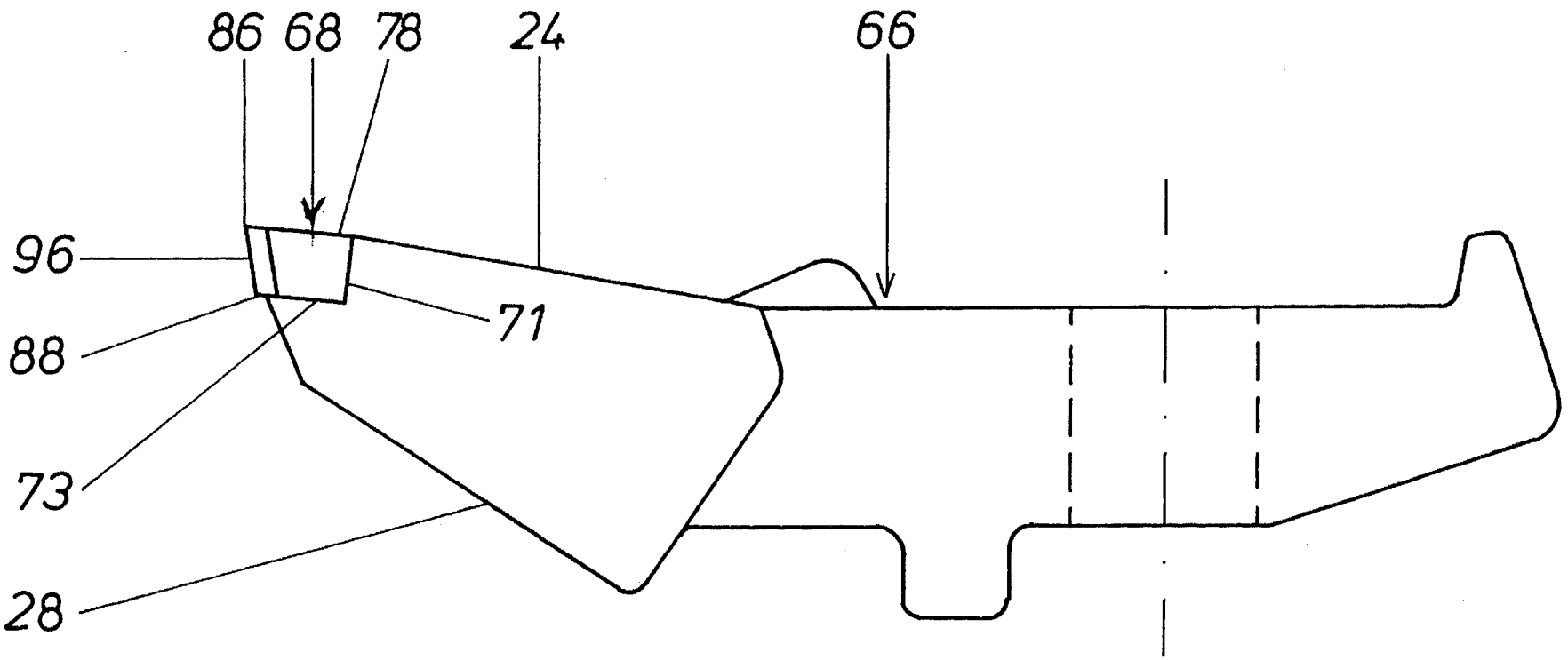
FIG. 6 is a side view of the cutting member as shown in FIG. 4.

A second exemplary embodiment of the inventive cutting member is illustrated in FIGS. 4 to 6 which show a cutting member 66 having essentially the same basic construction as the cutting member 10 shown in FIGS. 1 to 3. Thus the cutting head 12 has first and second sides 24 and 28 which define corresponding sides of the triangular cross-section of the cutting head 12 and converge to define a rim region 68, see FIG. 6, in which the cutting edge is formed.

Like in the exemplary embodiment as described hereinbefore with reference to FIGS. 1 to 3, the rim region 68, see FIG. 6, is formed with a cut-out for receiving a wearing body 70 which is composed of a plural number of wearing parts, in the present instance three wearing parts 72, 74 and 76. The wearing parts 72, 74 and 76 have substantially identical configuration and are firmly secured such as by welding to the side surfaces 71 and 73 of the cut-out.

Due to their identical configuration, only one of the wearing parts 72,74,76, namely the wearing part 76, will now be described. The wearing part 76 has a basically prismatic configuration. A first face 78 thereof, see FIG. 4, extends substantially in continuation of the first side 24 of the cutting head 12 and is delimited by two lateral edges 82 and 84 and a curved edge 86, see FIG. 5, which interconnects the two lateral edges 82 and 84 on the side remote from the side surface 71 of the cut-out. A second face 80 of the wearing part 76 extends from the second side 28 of the cutting head 12 generally parallel to the first face 78. This second face 80 is shown for better clarity in FIG. 5 in connection with the identically structured wearing part 72. The second face 80 is delimited by two lateral edges 90 and 92 and by a curved edge 88 which interconnects the two lateral edges 90 and 92. The lateral edges 82,90 and the opposite lateral edges 84,92 delimit respective lateral faces of which only the lateral face 94 is visible in FIG. 4. The invisible lateral face abuts the adjoining lateral face of the adjacent wearing part 74. The lateral faces merge with a curved face 96 which is delimited by the curved edges 86 and 88 and defines an exposed face.

In the juxtaposed relationship of the wearing parts 72,74, 76, the respective lateral surfaces abut each other and the curved edges 88 conjointly define a cutting edge composed of curved or arcuate sections 88. The curved face 96 may extend perpendicular to the first and second faces 78 and 80 but, as shown in FIG. 6, may also extend at an angle thereto so that the surface area of the first face 78 is greater than that of the second face 80 and the respective wearing part assumes a shape which is slightly conical in the region of the curved face 96.

Figure 7:
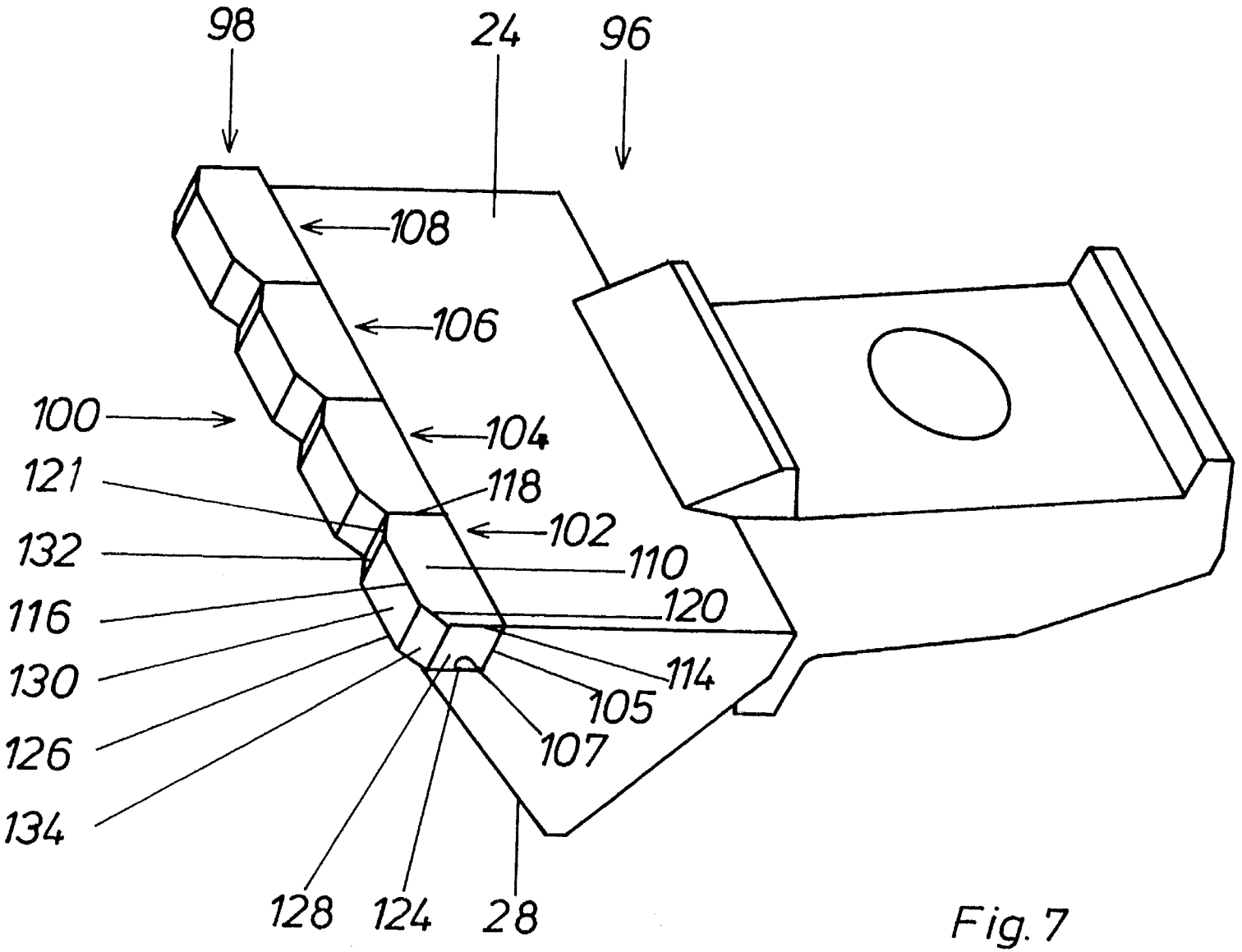
FIG. 7 is a perspective view of a third exemplary embodiment of the inventive cutting member from a first viewing direction toward a front side thereof as viewed in the rotational direction of the rotary impact mechanism in which the cutting member is installed.
Figure 8:
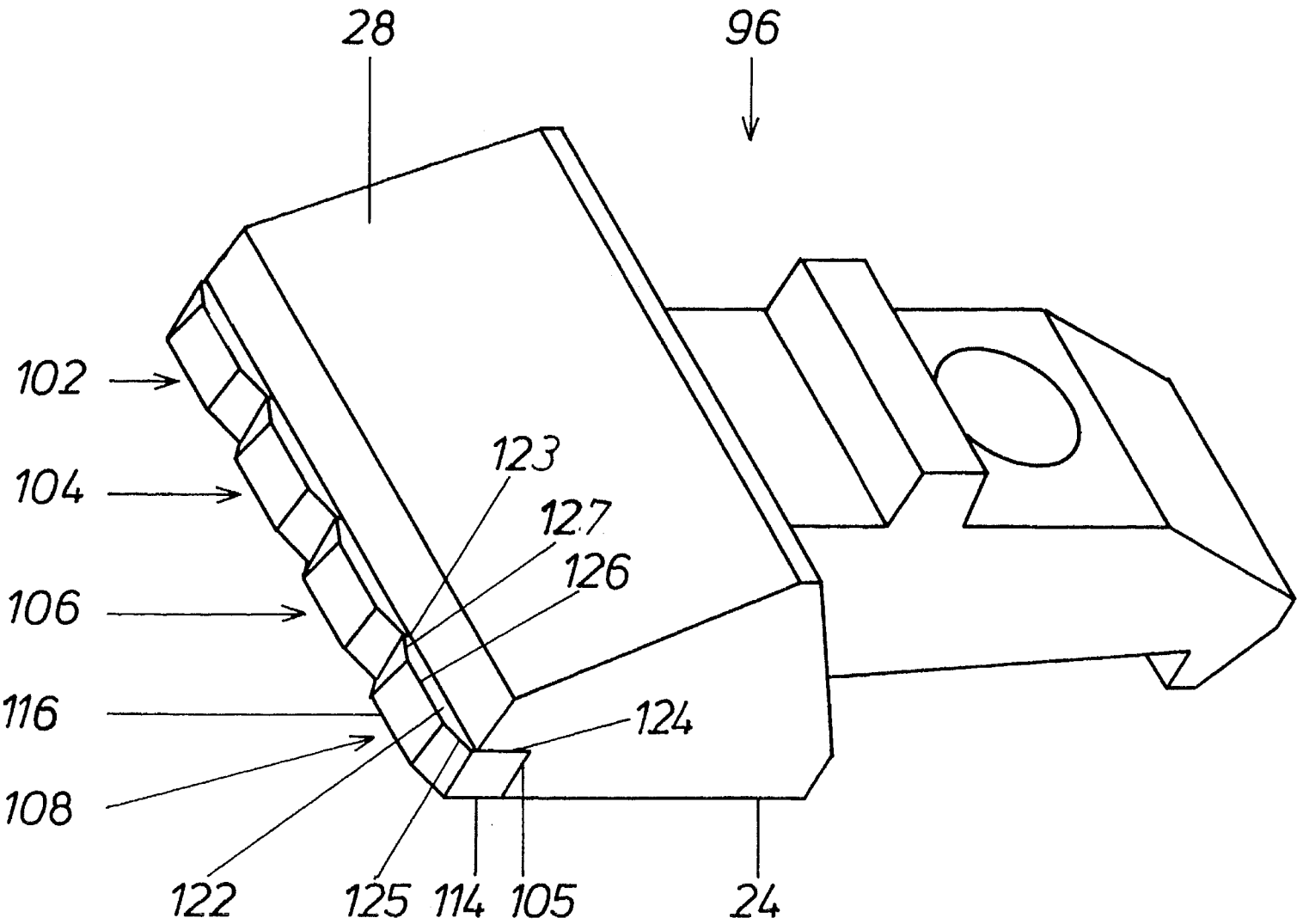
FIG. 8 is a perspective view of the cutting member as shown in FIG. 7 from a second viewing direction opposite to the first viewing direction and directed toward the rear side of the cutting member as viewed in the rotational direction of the rotary impact mechanism in which the cutting member is installed.

A third exemplary embodiment of the inventive cutting member is illustrated in FIGS. 7 and 8 which show a cutting member 96 having essentially the same basic construction as the cutting member 66 shown in FIGS. 4 to 6. Thus the cutting head 12 has first and second sides 24 and 28 which define corresponding sides of the substantially triangular cross-section of the cutting head 12 and converge to define a rim region 98 in which the cutting edge is formed.

Like in the exemplary embodiment as described hereinbefore with reference to FIGS. 4 to 6, the rim region 98 is formed with a cut-out for receiving a wearing body 100 which is composed of a plural number of wearing parts, in the present instance four wearing parts 102,104,106,108. The wearing parts 102,104,106,108 have substantially identical configuration and are firmly secured such as by welding to the side surfaces 105 and 107 of the cut-out.

Due to their identical configuration, only one of the wearing parts, namely the wearing part 102, will now be described. The wearing part 102 has a basically prismatic configuration. A first face 110 thereof, see FIG. 7, extends substantially in continuation of the first side 24 of the cutting head 12 and is delimited by two lateral edges 114 and 118 and a substantially straight edge 116 on the side remote from the side surface 105 of the cut-out. The opposite ends of the straight edge 116 are connected to the respective lateral edges 114 and 118 through respective oblique edges 120 and 121. A second face 122 of the wearing part 102 extends from the second side 28 of the cutting head 12 generally parallel to the first face 110. This second face 122 is shown for better clarity in FIG. 8 in connection with the identically structured wearing part 108. The second face 122 is delimited by two lateral edges 123 and 124 and a straight edge 126 having opposite ends which are connected to the respective lateral edges 123 and 124 through respective oblique edges 127 and 125. The lateral edges 114,124 and 118,123 delimit respective lateral faces of which only the lateral face 128 is visible in FIG. 4. The invisible lateral face abuts the adjoining lateral face of the adjacent wearing part 104. The straight edge 116 and the straight edge 126 define a planar face 130 or exposed face on the side remote from the side surface 105 of the cut-out. The lateral faces merge with oblique or bevelled faces 132,134 which are formed in the corner or transition region between the planar face and the lateral faces.

In the juxtaposed relationship of the wearing parts 102, 104,106,108 the respective lateral faces abut each other and the straight edges 126 conjointly with the oblique edges 125,127 define a cutting edge composed of linear and oblique sections. The planar face 130 and the oblique faces 132,134 may extend perpendicular to the first face 110 and the second face 122 but, as shown in FIG. 8, may also extend at an angle thereto so that the surface area of the first face 110 is greater than that of the second face 122.

In all of the aforedescribed exemplary embodiments, the wearing parts are disposed in abutting juxtaposed relationship in a manner such that there is defined a substantially uninterrupted cutting edge by the edge or edges which delimit the second face of each wearing part.

While there are shown and described present preferred embodiments of the invention, it is to be distinctly understood that the invention is not limited thereto, but may be otherwise variously embodied and practiced within the scope of the following claims. Accordingly,

What I claim is:

1. A cutting member of a flail for use in a comminuting machine, comprising:

a cutting head having a substantially triangular cross-section defining a first side and a second side;

said first side and said second side converging with the formation of a rim region in which a cutting edge is defined;

a wearing body made of hard metal;

said wearing body being positioned in a cut-out in said rim region and defining said cutting edge;

said wearing body being composed of a plural number of wearing parts disposed in juxtaposed relationship along said rim region;

each one of said wearing parts defining a first face extending substantially in continuation of said first side of said cutting member, and a second face extending from said second side of said cutting member;

said first face of each one of said wearing parts being delimited by opposite lateral edges and a first further edge interconnecting said opposite lateral edges;

said second face of each one of said wearing parts being delimited by opposite lateral edges and a second further edge interconnecting said opposite lateral edges; and at least one of said first and second further edges defining said cutting edge.

2. The cutting member as defined in claim 1, wherein said plural number of wearing parts have substantially identical configurations.

3. The cutting member as defined in claim 2 wherein:

said lateral edges define respective lateral faces on opposite lateral sides of said wearing part;

said lateral faces of said wearing part being interconnected by an exposed face of said wearing part; and said exposed face of said wearing part being delimited by said first and second further edges.

4. The cutting member as defined in claim 3, wherein said first face and said second face extend substantially parallel to each other.

5. The cutting member as defined in claim 4, wherein said exposed face extends substantially perpendicular to said first face and said second face.

6. The cutting member as defined in claim 4, wherein:

said first face has a surface area which is greater than the face area of said second face of said wearing part; and said exposed surface extends at an angle between said first face and said second face.

7. The cutting member as defined in claim 4, wherein:

said exposed face constitutes a planar face; and oblique faces interconnecting said planar face of said wearing part and said respective lateral faces on said opposite lateral sides of said wearing part.

8. The cutting member as defined in claim 4, wherein said exposed face constitutes a curved face.

9. The cutting member as defined in claim 3, wherein:

said further edge delimiting said first face of said wearing part is defined by two edges extending from respective ones of said opposite lateral edges toward each other and enclosing an obtuse angle;

said further edge delimiting said second face of said wearing part being defined by two edges extending from respective ones of said opposite lateral edges toward each other and enclosing an obtuse angle;

said two edges delimiting said first face and said two edges delimiting said second face, delimiting lateral faces ascending from the respective lateral edges and converging in a ridge; and said ridge being disposed symmetrically with respect to said lateral edges.

10. The cutting member as defined in claim 9, wherein:

said first face has a greater surface area than said second face; and said ridge being offset in a direction away from said first side of said cutting head.

11. The cutting member as defined in claim 9, wherein said two edges delimiting said second face, define said cutting edge of said wearing part.

* * * * *